US005608196A

United States Patent [19]

Hall et al.

[11] Patent Number: 5,608,196

[45] Date of Patent: Mar. 4, 1997

[54] NORMALLY CLOSED DIMMER SWITCH CONTACT ASSEMBLY SEPARATED BY ROCKER ACTUATOR INTERPOSED INSULATION PLATE

[75] Inventors: Lawrence A. Hall; Richard P. Hepner, both of Harrisburg, Pa.

[73] Assignee: The Whitaker Corporation, Wilmington, Del.

[21] Appl. No.: 526,122

[22] Filed: Sep. 8, 1995

[51] Int. Cl.[6] ..... H01H 27/04

[52] U.S. Cl. ..... 200/61.19; 200/339; 200/506

[58] Field of Search ..... 200/1 R, 5 R, 200/6 R–6 C, 17 R, 18, 61.19, 506, 558, 559, 329–339; 307/114, 115, 125; 174/53; 338/183; 323/239, 320–324

[56] References Cited

U.S. PATENT DOCUMENTS

| | | | |
|---|---|---|---|
| 2,253,968 | 8/1941 | Cook | 200/506 |
| 2,254,347 | 9/1941 | Blakesley | 200/61.19 |
| 2,671,150 | 3/1954 | Attias | 200/558 |
| 4,425,487 | 1/1984 | Hsieh | 200/17 R X |
| 4,520,306 | 5/1985 | Kirby | 323/324 |
| 4,563,592 | 1/1986 | Yuhasz et al. | 307/115 |
| 4,672,229 | 6/1987 | Skarman et al. | 307/115 |
| 4,745,351 | 5/1988 | Rowen et al. | 323/239 |
| 4,783,581 | 11/1988 | Floers et al. | 200/332 |
| 4,871,893 | 10/1989 | Slovak et al. | 200/16 R |
| 4,873,403 | 10/1989 | Counts et al. | 307/115 X |
| 4,880,950 | 11/1989 | Carson et al. | 338/183 X |
| 4,988,840 | 1/1991 | Carson et al. | 200/334 |
| 5,004,972 | 4/1991 | Roth | 323/320 |
| 5,196,782 | 3/1993 | D'Aleo et al. | 323/320 |
| 5,262,678 | 11/1993 | Flowers et al. | 307/125 |
| 5,283,516 | 2/1994 | Lohoff | 323/322 |
| 5,315,082 | 5/1994 | Liao | 200/61.19 X |
| 5,359,231 | 10/1994 | Flowers et al. | 307/125 |
| 5,445,539 | 8/1995 | Dale | 174/53 X |

OTHER PUBLICATIONS

Sample—Lightolier 82–0245 P.N.

Sample—Leviton Manufacturing Company, Inc 6606–GSP P.N.

Sample—Power Controls Corporation 360067 P.N.

Leviton Introduces the Exciting New "Decora Touch Dimmer"; 2 pages.

Impressions "Installation Guidelines"; 2 pages.

*Primary Examiner*—J. R. Scott

*Attorney, Agent, or Firm*—Robert W. Pitts; Katherine A. Nelson

[57] ABSTRACT

A dimmer switch 2 for use in a lighting or electrical power control system includes an air gap switch 20 for open circuiting the load from the source of electrical power. Normal load control is provided by power control circuitry on a printed circuit board 24 in the dimmer switch 2. The air gap switch 20 includes two opposed contact springs 30 mounted on the same printed circuit board. These contact springs 30 include contact tabs 32 normally held in contact. An air gap actuator post 50 molded on one end of a dimmer switch rocker 4 can be moved between the contact tabs 32 to open the air gap switch 20. Convex latching surfaces or ridges 38 on each contact spring 30 engage channels 52 on the air gap actuator post 50 to disengagably hold the post 50 in place. The rocker 4 is rotated from a neutral position to a normal actuation position to activate push button switches 26 on the printed circuit board 24, and the rocker 4 can be rotated further to bring the air gap actuator between contact tabs 32. Opposite rotation of the rocker releases the air gap actuator 52 and closes the air gap switch.

15 Claims, 7 Drawing Sheets

NORMALLY CLOSED DIMMER SWITCH CONTACT ASSEMBLY SEPARATED BY ROCKER ACTUATOR INTERPOSED INSULATION PLATE

FIELD OF THE INVENTION

This invention is related to air gap switch that are used with electronic dimmer switches. Triacs are typically used to control the power delivered to a load connected to a dimmer switch, but a air gap switch must be provided to open the circuit between the source and the load.

BACKGROUND OF THE INVENTION

Triacs are commonly used to regulate the proportional electrical power delivered to a load, and comprise the main power control element of a number of conventional dimmer switches used to control electrical lighting control loads. A triac gate signal controls the portion of the time during each normal alternating current half cycle during which the triac is conductive in order to vary the power delivered to a load and therefore to control the intensity of a load such as an electrical lighting fixture.

Although a triac can reduce the amount of power delivered to a load to the point at which the load is "effectively" off, a triac provides no means to open circuit a load or to completely disconnect a load from a source of electrical power. Therefore if the triac or some other component of a lighting control unit or system fails, it is conceivable that the device or system could fail in the closed condition in which power is delivered to the load. The triac or power control circuit used in normal operation could not then disconnect the load from the source.

For this reason, air gap switches that can open circuit the connection between a source and a load independently of a triac are required on dimmer switches. An air gap switch is required in dimmer switches used in the United States by Underwriters Laboratories (UL) Specification 172. A dimmer switch must meet the requirements of an appropriate specification of UL or some other recognized component testing agency in order to meet the requirements of the National Electric Code (NEC) and to meet applicable local electrical or building codes.

Air gap switches of various types are used in commercial dimmers or dimmer switches. One approach is to employ a conventional snap switch type toggle actuator as the main ON-OFF control and to provide a separate slider switch as an independent means for setting the intensity of the light or other load attached to the switch. U.S. Pat. No. 5,359,231 discloses a wall box dimmer of this type.

Other conventional dimmers use a rocker switch actuator that is pivoted about its centerline for local dimmer input. These switches do not use a conventional toggle type actuator, but employ a rectangular decorator type rocker that has either a flat or slightly inclined surfaces on the front of the rocker. These actuators engage two printed circuit board push button switches to provide UP-DOWN or BRIGHT-DIM inputs to power control circuitry located on the printed circuit board. Several different types of air gap switches are used with dimmers of this type. One approach is to use a general purpose printed circuit board slide switch that is located below one end of the rocker, typically the lower end. A slider actuator that includes a molded section engaging a slide switch actuator because this actuator is not exposed on the front surface of the dimmer. Touch dimmers also employ a general purpose slide switch with a specially molded slide actuator of this type.

Another type of air gap switch is disclosed in U.S. Pat. No. 4,783,581. That switch is formed of two contacts which are biased together in electrical contact by an elongated flat metal strip. A control lever is coupled to a cam. When the control lever is moved to the OFF position, the cam abuts the metal strip, forcing the strip to move in a direction opposite to its bias, thereby separating the two contacts and making electrical contact.

Still other air gap switches used in dimmer switches employ a metal leaf spring with a special contact button attached to its end. The spring holds the contact button in contact with a mating button, usually mounted on the printed circuit board to which the leaf spring is also attached. An actuator can moved into engagement with the leaf spring to force the air gap switch open. A commercial version of the dimmer switch shown in U.S. Pat. No. 5,283,516, manufactured and sold by Pass & Seymour Legrand is believed to use an air gap switch of this type. The air gap actuator used in that commercial product comprises a rotating ratcheting pin arrangement, believed to function in much the same manner as ball point pens to hold the air gap switch in an open position. A leaf spring switch is also shown in U.S. Pat. No. 4,988,840.

Another commercially available dimmer switch is manufactured by Lightolier Incorporated. The rocker used in that dimmer switch can be pivoted from a neutral position to a position in which a printed circuit board push button or key switch is activated. The OFF push button switch is actuated by a coil spring positioned between the rocker actuator and the push button or key switch. Further rotation of the rocker beyond the normal OFF position causes the actuator to open the air gap switch. The rocker engages a separate cylindrical post positioned in a tubular guide. This post opens a leaf spring contact, of the type described in U.S. Pat. No. 4,988,840, that has a contact button attached to the end to engage a contact mounted on the printed circuit board. The rocker of that prior art dimmer switch includes a detent or channel that is engaged by a ridge on a separate spring or clip to latch the rocker so that the air gap switch remains in the open position. This air gap actuator assembly includes a number of separate components that must be assembled. The additional assembly steps add to the manufacturing cost of the dimmer switch.

SUMMARY OF THE INVENTION

The air gap switches used on prior art dimmers have several shortcomings. In some cases the aesthetics of the air gap actuator are objectionable. Prior art air gap switches can also be quite large and take up valuable printed circuit board real estate. Relatively expensive components, such as contact buttons may also be required. Many of the prior art devices employ additional elements, such as special actuators or clips that must be assembled. Hand assembly of these additional components is believed to be necessary. Elimination of additional components and assembly steps is therefore an important aspect of the instant invention. The air gap switch components depicted herein are either integral parts of other switch components or they are installed as part of other operations, such as the installation of contact springs to the printed circuit board during printed circuit board loading and the integral molding of the actuator post on the rocker. The contact springs themselves are simple relatively inexpensive stamped and formed parts.

The air gap switch of the present invention includes two opposed spring contacts that normally are in contact along a mating interface surface. When the dimmer switch rocker is rotated beyond the position in which the off push button switch is engaged, an actuator post molded as an integral part of the dimmer rocker separates the opposed spring contacts. Coil springs actuating the push button switches allow overtravel of the rocker. A convex surface on the air gap spring contacts engages a corresponding channel on the side of the air gap actuator post and the spring force of the contacts holds the actuator in position between the air gap contacts. Opposite pressure on the dimmer rocker releases the actuator and the air gap switch is returned to its closed position connecting an electrical source with a load through the dimmer switch.

An embodiment of the invention will now be described by way of example with reference to the accompanying drawings.

BRIEF DESCRIPTION OF THE DRAWINGS

FIG. 3 is a side view of the dimmer with the dimmer actuator or rocker in a first or neutral position.

FIG. 13 is a view of the printed circuit board showing the notch through which the air gap switch contact springs extend.

DETAILED DESCRIPTION OF THE PREFERRED EMBODIMENT

The dimmer switch 2 depicted herein is primarily intended for use in a power or lighting control system of the type originally described in U.S. patent application Ser. No. 08/303,967, filed Sep. 9, 1994, now abandoned, incorporated by reference herein. It should be understood however that dimmer switch 2 can be used with other systems, and the air gap switch subassembly used in dimmer switch 2 can be used in other dimmer switches and with other lighting or power control systems.

Dimmer switch 2 is connected between a source of alternating current electrical power and a load to be dimmed or proportionally controlled. Although primarily intended for use in dimming incandescent lighting loads, this dimmer can also be used to dim inductive and other types of loads. The preferred embodiment of dimmer switch 2 is intended to be used in applications where the load or loads attached directly to the dimmer switch is to be controlled directly by the dimmer switch 2 or by remote switches or remote controllers forming other components of the lighting or power control system of which dimmer switch 2 is a part. Dimmer switch 2 is however connected directly to one or more loads and dimmer switch 2 contains an air gap switch 20 that forms a part of the circuit to which the load is attached. This air gap switch 20 can be opened to disconnect the load from the source of electrical power. When the air gap switch 20 is in its open position, no power can be delivered to the load, even if other components of the dimmer switch malfunction or even if other elements or components of the lighting or power control system malfunction. An air gap switch of this type is required in dimmer switches used in the United States by Underwriters Laboratories (UL) Specification 172. A dimmer switch must meet the requirements of an appropriate specification of UL or some other recognized component testing agency in order to meet the requirements of the National Electric Code (NEC) and to meet applicable local electrical or building codes.

Figure 1:
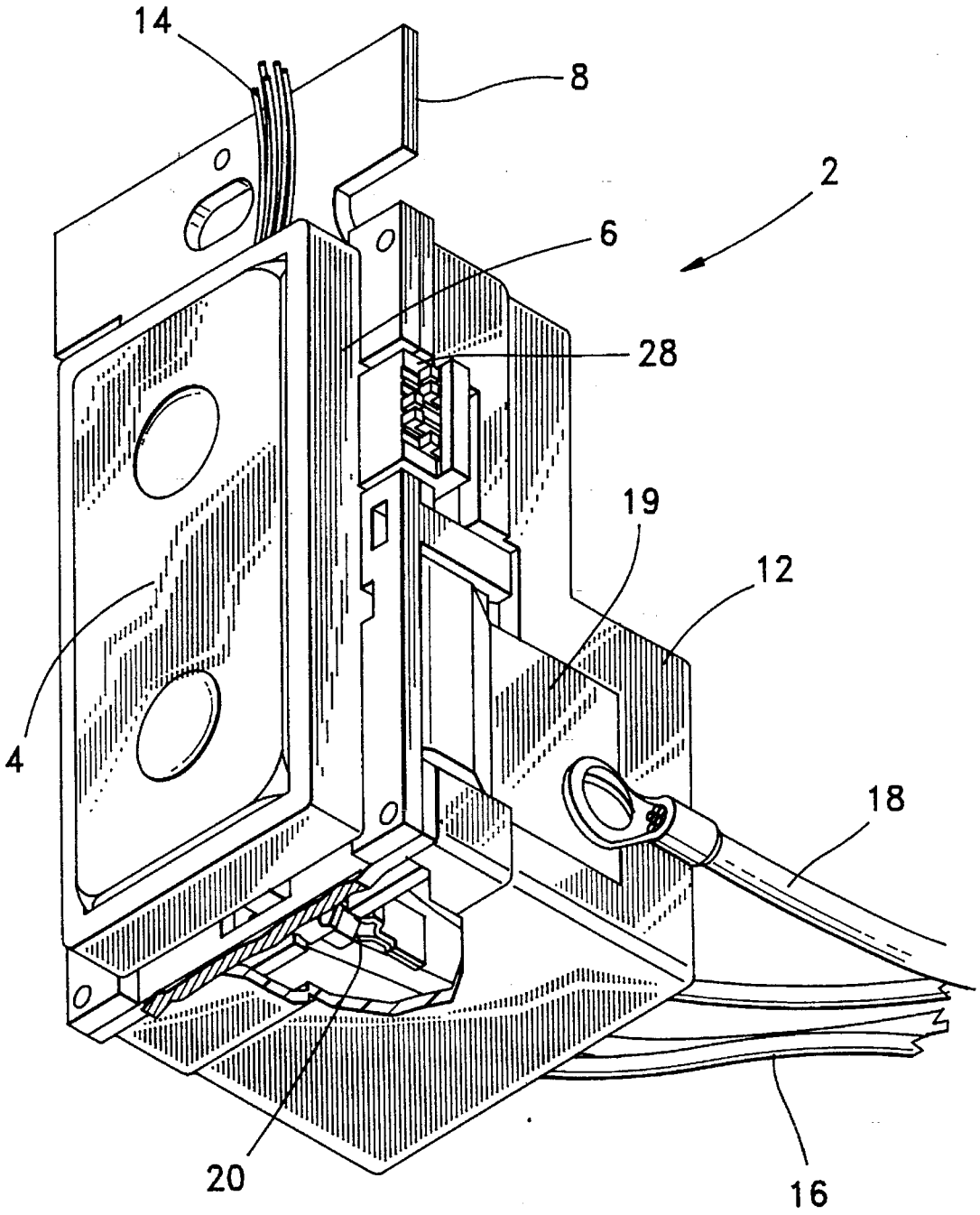
FIG. 1 is a perspective view of a dimmer switch for use in controlling electrical loads such as lighting loads. A portion of the dimmer is broken away to expose the dimmer air gap switch.
Figure 2:
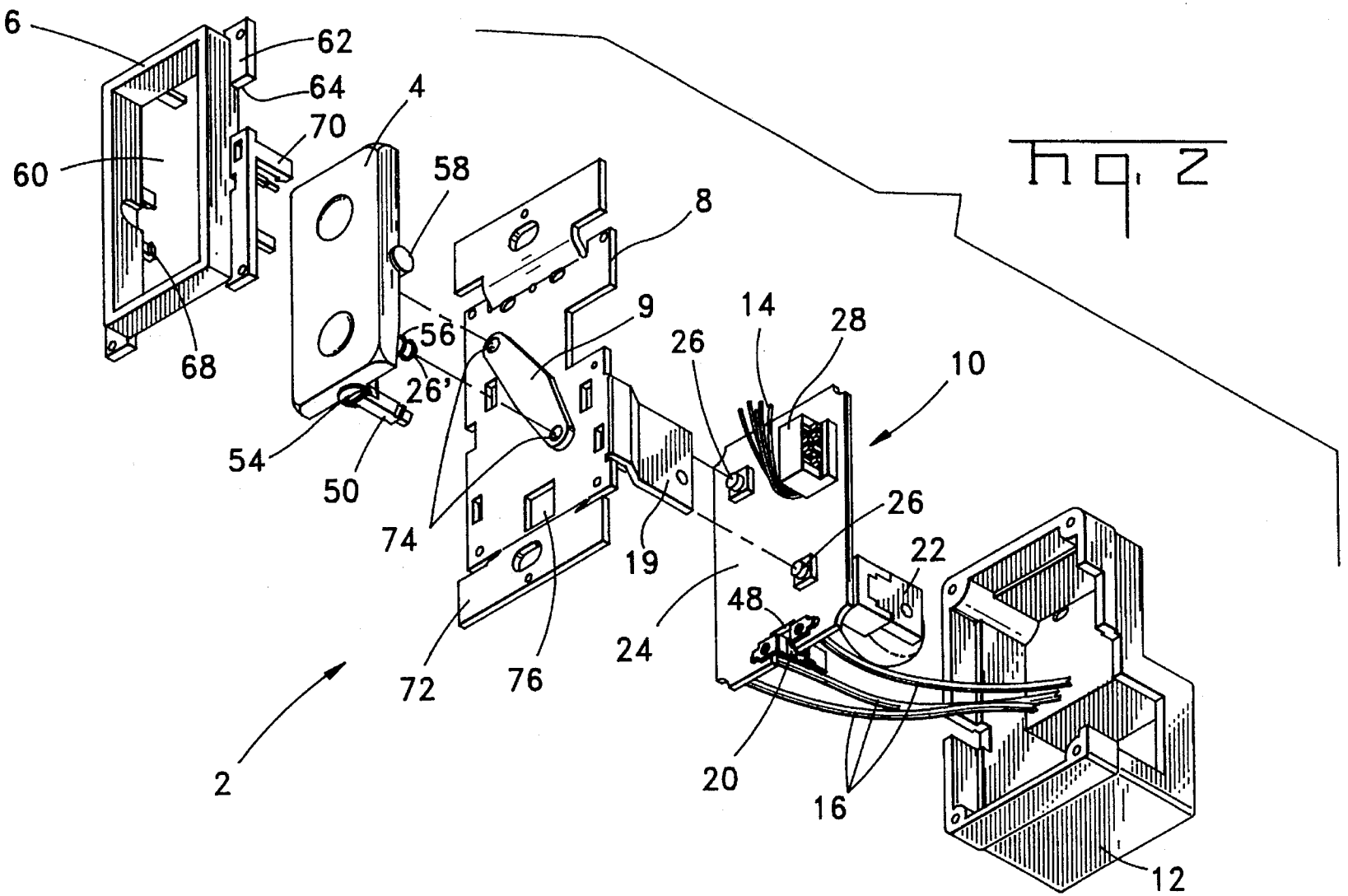
FIG. 2 is an exploded perspective view of the major components and component subassemblies comprising this dimmer.

The major components and subassemblies of dimmer switch 2 are shown in the exploded perspective view of FIG. 2. Dimmer switch 2 includes a rocker actuator 4 mounted in a bezel 6 on the exterior of a metal mounting flange plate 8. A printed circuit board subassembly 10 including power control circuitry and input and output terminations to the source and load is mounted to the metal mounting flange plate 8 and is positioned in a housing 12. Dimmer switch 2 is assembled by first positioning the rocker switch subassembly 4 in the bezel 6 and then mounting this rocker-bezel subassembly to the mounting flange plate 8. The printed circuit board subassembly 10 is then snapped to the bezel 6 on the opposite side of the mounting flange plate 8. This subassembly comprising the rocker 4, bezel 6, the mounting plate 8, and the printed circuit board subassembly 10 is then inserted into the housing 12 and secured in place by screws or other appropriate fasteners.

The power control circuitry, including the triac 22 used to regulate electrical power delivered to the load, is packaged on printed circuit board 24. This power control circuitry is described in greater detail in U.S. patent application Ser. No. 08/303,967, filed Sep. 9, 1994. Leads or pigtails 16 are soldered or terminated to the printed circuit board 24 in conventional fashion. In this embodiment one lead connects the dimmer switch 2 to a source of electrical power, the hot wire; one lead connects the dimmer switch to neutral; and a third lead connects the load, such as a lighting unit, to the dimmer switch. A safety ground lead 18 is attached directly to the mounting flange 19 of the plate 8, bypassing the printed circuit board 24. These four leads are attached to standard electrical wiring, for example to NM cable by using wire nuts or other conventional fasteners and the entire dimmer switch assembly is mounted in a conventional wall box. The air gap switch 20 includes two contact springs 30 that are also mounted on the printed circuit board 24 in conventional fashion. This air gap switch is located on the printed circuit board trace 25, FIG. 13, that connects the hot lead with the lead connecting the dimmer switch 2 to its load so that this connection can be open-circuited by the air gap switch. In addition to the leads 16 and 18, this dimmer switch also includes a low voltage connection using low voltage signal wires 14 to connect the dimmer switch to a lighting control system and to remote control units. A dip switch 28 is also mounted on the printed circuit board. This dip switch can be set to provide each individual dimmer switch 2 with a unique address.

Figures 1, 9:
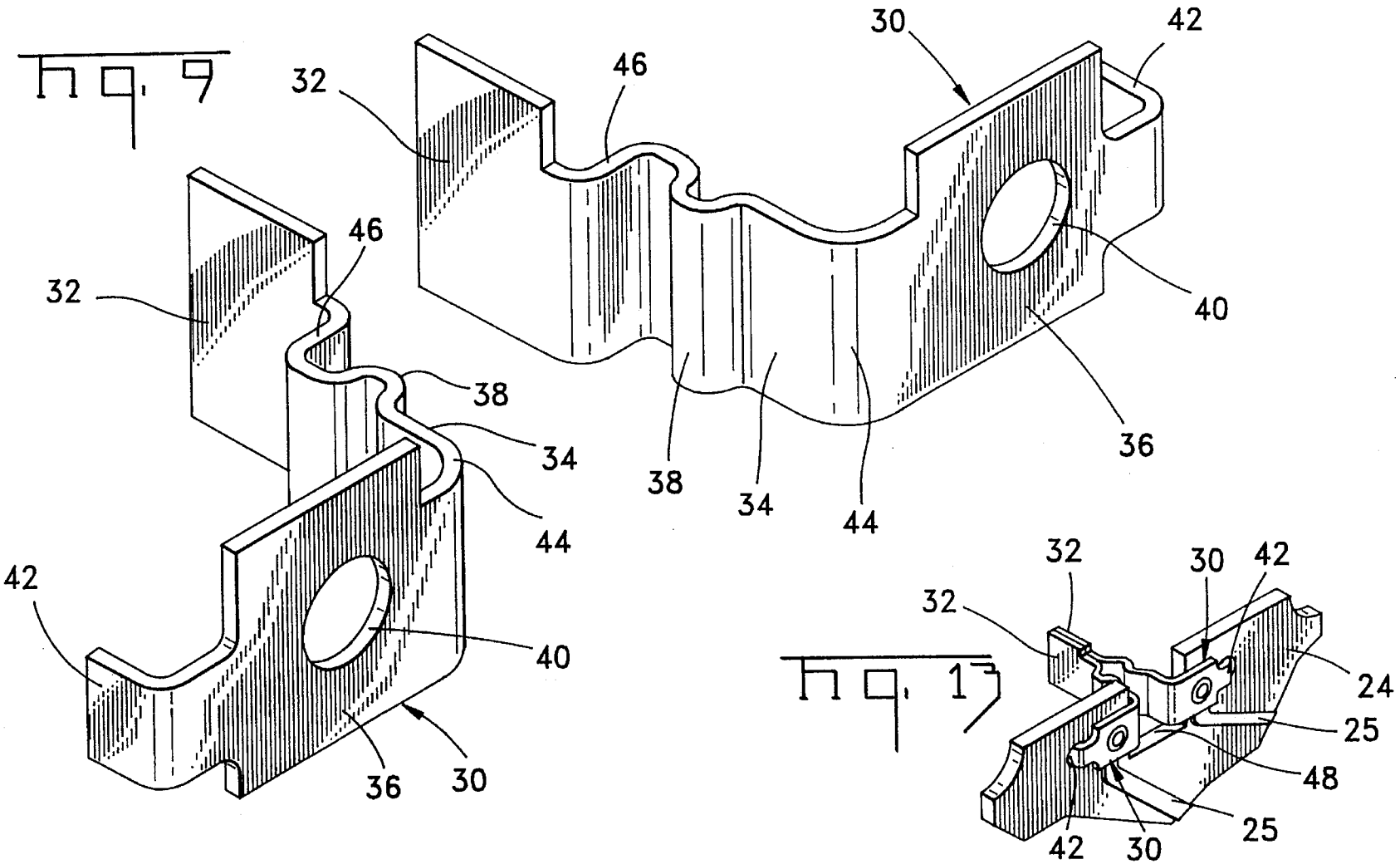
FIG. 9 is a perspective view of the two contact springs employed in the air gap switch.

The air gap switch 20 includes two air gap contact springs 30 mounted on printed circuit board 24 and an air gap actuator post 50 that comprises an integral extension on one end 54 of the rocker 4. The structure of the contact springs 30 are shown in more detail in FIG. 9. The structure of the rocker 4 and the rocker extension forming the air gap actuator post 50 is shown in more detail in FIGS. 10–12.

The two air gap switch contact springs 30 are substantially mirror images. In the preferred embodiment, the two contact springs 30 differ only in that the contact sections or tabs 32 are slightly wider than the remainder of the contacts and are offset relative to the centerline of the remainder of the contact resulting in a right and a left contact springs 30 that are opposed when used to form the air gap switch 20. The contact springs 30 are stamped and formed from a spring metal, such as Beryllium Copper.

The contacts tabs 32 are substantially flat plates located at one end of each contact 30. When the air gap switch 20 is in the closed position as shown for example in FIGS. 3 and 4, opposed contact tabs engage each other along a central mating interface surface. Sufficient contact force is developed to insure that these contact tabs 32 establish a satisfactory electrical contact so that sufficient power can be delivered to the load through the closed air gap switch 30. The mating interface exhibits low resistance so that heat buildup is not a problem. Each contact tab joins an intermediate section 34 that is offset from the mating interface surface. A portion 46 of the contact extends away from the mating interface surface below a convex surface or ridge 38 located in the middle of the intermediate section 34. The outer surface of this convex ridge extends toward the mating interface surface but remains spaced from the mating interface so that opposed convex surfaces 38 on the two opposed contact springs 30 do not come into contact when the air gap switch is in the closed position. Each of the convex surfaces or ridges 38 is in the form of a cylindrical stamped surface whose axis extends substantially perpendicular to the longitudinal axis of the contact spring 30.

A contact mounting section 36 extends from the opposite end of the intermediate section 34 and is joined to the intermediate section 34 by a right angle bend 44. Each mounting section includes a mounting hole 40 and a downwardly formed tab 42 located at the end of the contact spring 30. Each contact spring 30 can be mounted to a printed circuit board by a rivet, see FIG. 2. The tab 42 extends through a hole 48, FIG. 18, in the printed circuit board 24 on which the air gap switch 20 is mounted. Tab 42 helps orient the contact springs so that they are positioned opposite each other and provides a point of solder for interconnection to the board. The intermediate section 34 extends through a notch 48 in the printed circuit board 24 and the contact tabs are located below the printed circuit board notch 48. (See FIG. 2). The portion of each contact spring 30 located below the printed circuit board 24, and especially the mating interface surface formed by the contact between tabs 32, are exposed by the notch 48 so that the air gap switch 20 can be opened.

The air gap switch 20 is maintained in the closed position by the inherent spring force developed by the two contact springs 30. Air gap switch 20 is opened by an actuator post 50 that forms an extension on one end of the rocker 4. When the rocker 4 is positioned relative to the printed circuit board subassembly by the bezel 6, the actuator post 50 extends through an opening 76 near one end 72 of the flange plate 8, FIG. 2, and partially through the notch 48, and actuator post is aligned with the mating interface surface. The end of the actuator post is however spaced from the contact springs 30 when the air gap switch 20 is in the closed position. The actuator post 50 is molded from the same insulative material as the rocker 4. In the preferred embodiment of this invention the rocker 4 and post 50 are integrally molded from a nonconductive engineering material such as Bayblend FR110 manufactured by Miles Polymers or Valox, an engineering polyester resin manufactured by General Electric.

Figure 7:
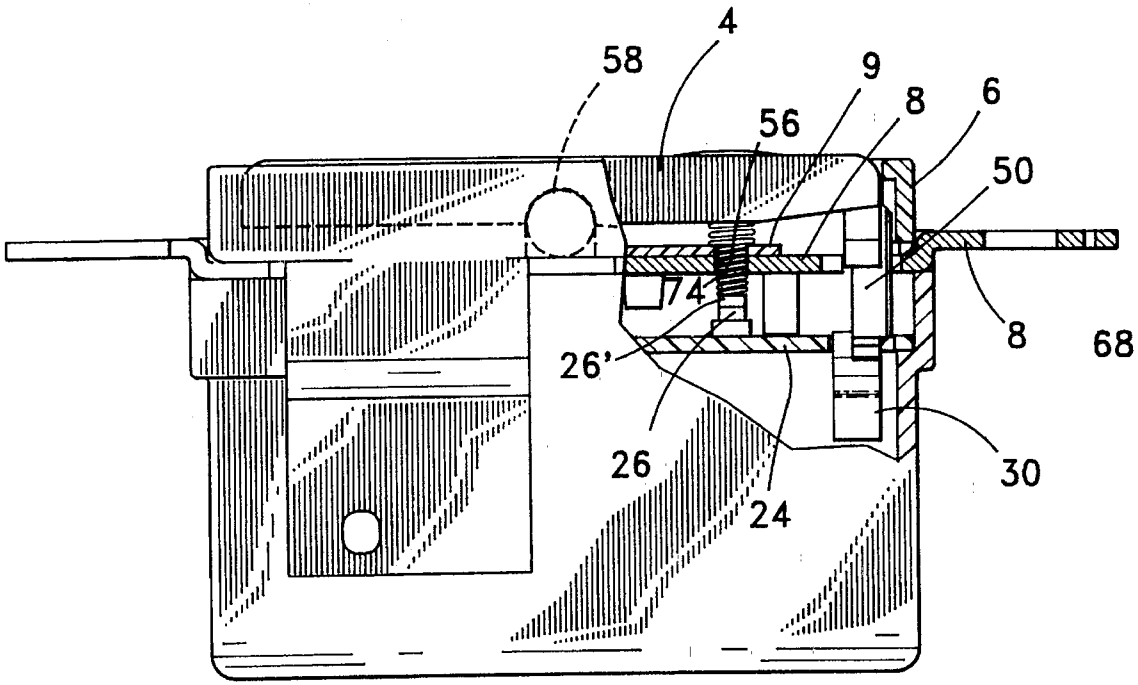
FIG. 7 is a side view, similar to FIGS. 3 and 5, showing the rocker in a third position in which the rocker engages the air gap switch to open the air gap switch and to open the circuit between the source and the load.
Figure 8:
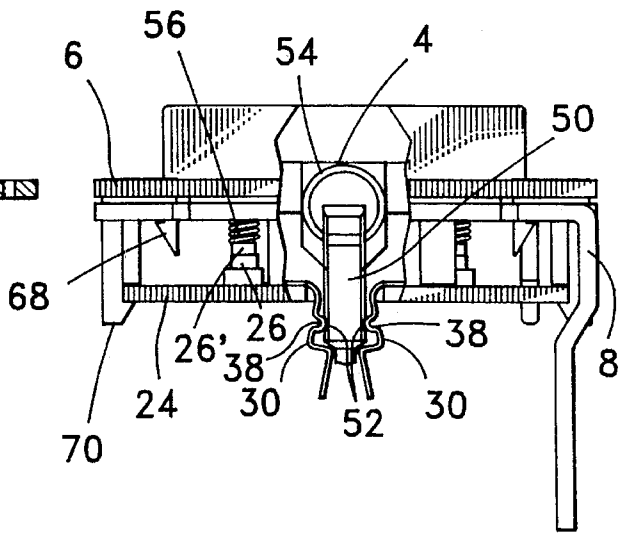
FIG. 8 is an end view, similar to FIGS. 4 and 6, showing the rocker and air gap switch in the position shown in FIG. 7.
Figure 7:
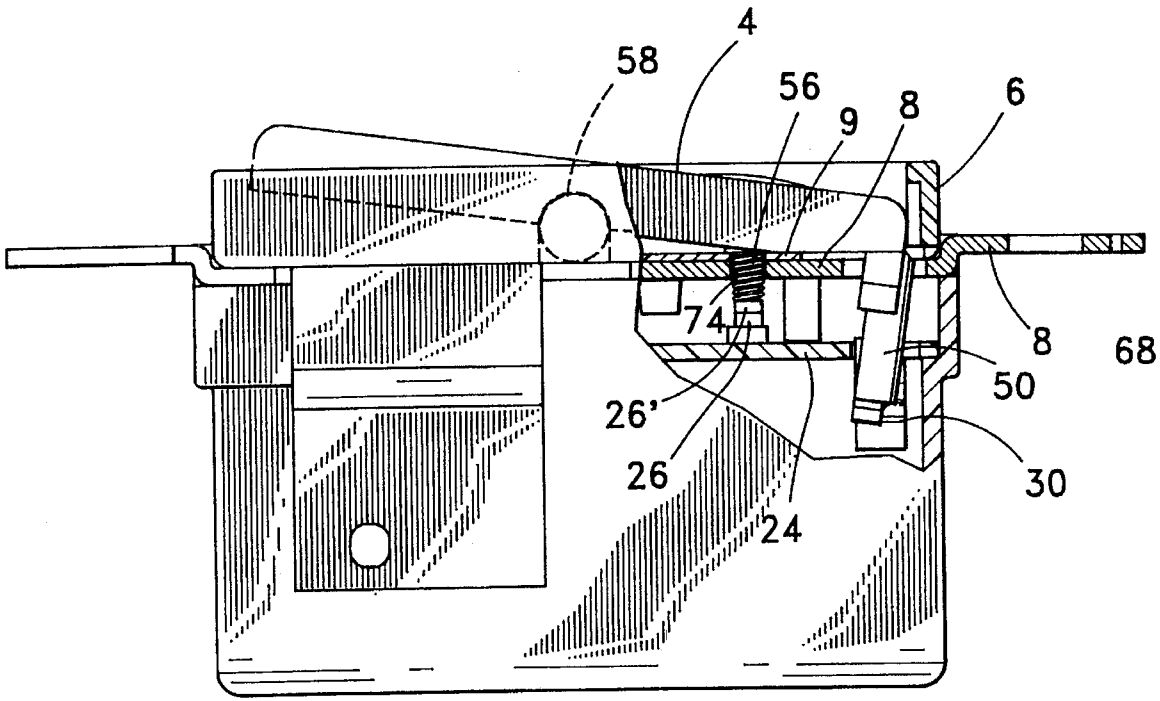
Figure 10:
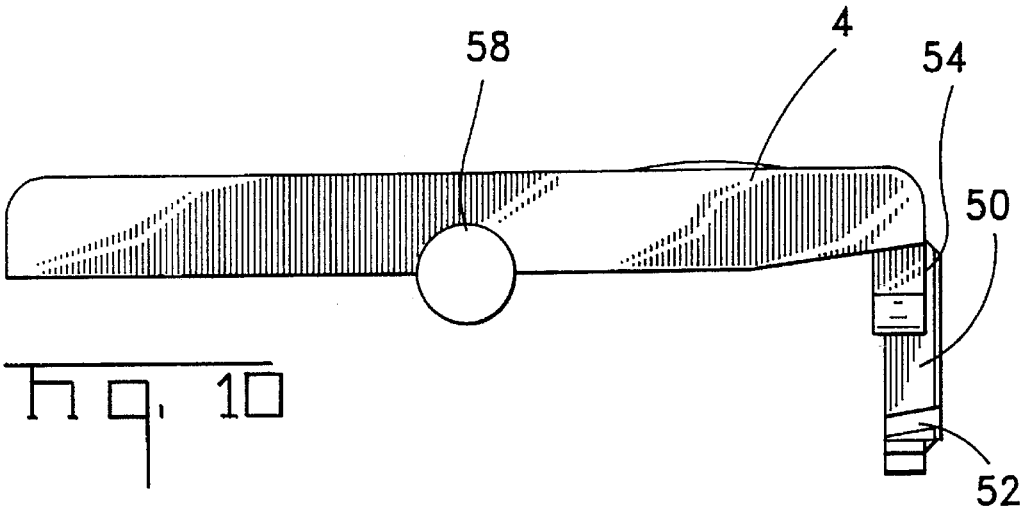
FIG. 10 is a side view of the rocker actuator showing the extension for opening the air gap switch.
Figure 11:
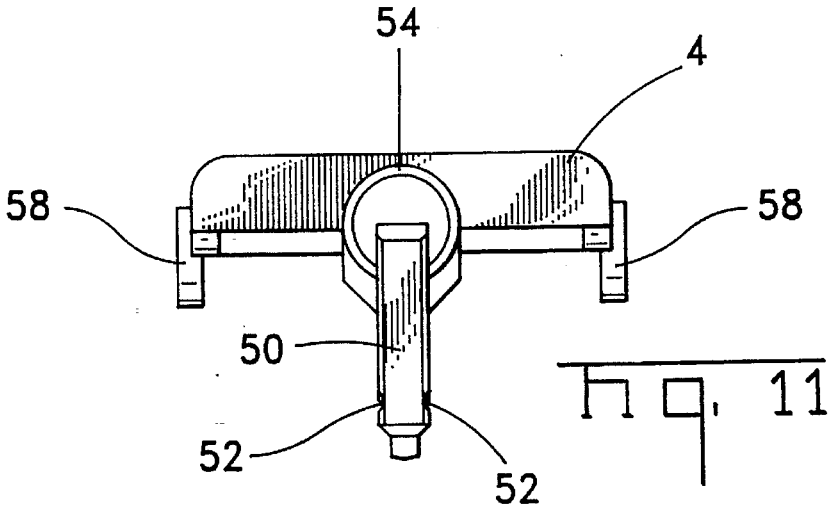
FIG. 11 is an end view of the rocker also showing the extension for opening the air gap switch.
Figure 12:
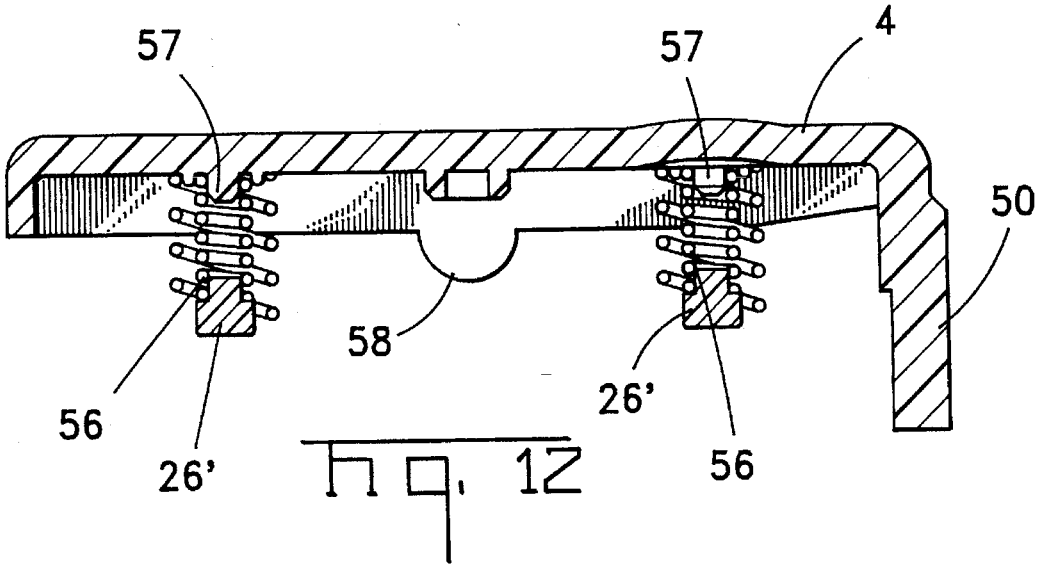
FIG. 12 is a section view of the rocker showing the springs used to activate the push button switch contacts which provide the normal local input on the dimmer.

As shown in FIGS. 10 and 11, each actuator post 50 includes inclined latching channels or grooves 52 on opposite sides. These channels 52 are inclined so that they will be substantially parallel to the printed circuit board 24 when the rocker 4 is rotated to the full extent of its travel as shown in FIGS. 7 and 8. The depth of channels 52 is sufficient to receive the convex surface or ridges 38 on the contact spring and this interengagement will cause the actuator post 50 to be held in position by the spring force of the contacts 30 when the rocker 4 is rotated to the position of FIGS. 7 and 8. The rocker 4 can be rotated or pivoted about a central axis and cylindrical bosses 58 are located on the rockers transverse centerline. Actuator springs 56 are held in position on the lower side of the rocker 4. These actuator springs 56 pass through holes 74 in the mounting flange plate 8 and through an elongated plate 9 placed against the mounting flange plate 8, and engage two push button switches or key switches 26 on printed circuit board 24 to provide UP-DOWN or ON-OFF inputs as the rocker is rotated or pivoted. Springs 56 are used to permit overtravel of the actuator post 50 without applying excessive force to the push button switches 26 when the air gap switch 20 is opened. Each spring 56 is secured to the bottom projections 57 of the rocker 4 by an interference fit and a plastic piston 26' is secured in the end of the spring, also by an interference fit. This plastic piston, which is spring loaded relative to the piston, is the component that actually engages the corresponding push button switch 26.

Figure 4:
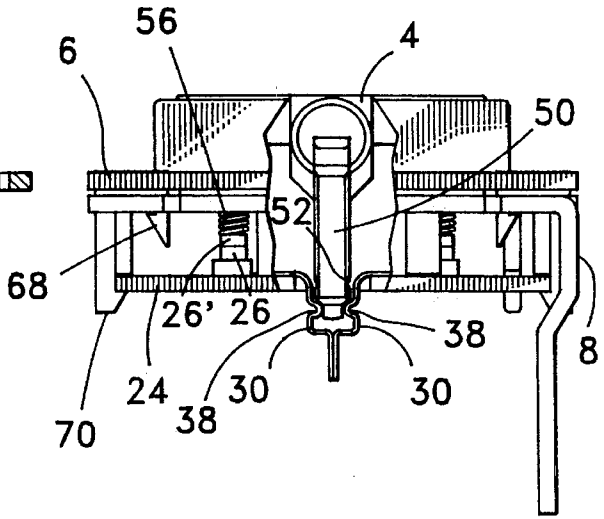
FIG. 4 is an end view of a partial subassembly showing the rocker in the first position or neutral position shown in FIG. 3.

FIGS. 3–8 show three of the four possible positions of rocker 4 and also shows the manner in which the air gap switch 20 is activated. In its assembled configuration, the rocker is mounted within a frontal bezel opening 60 with the central pivoting boss in engagement with the exterior surface of the mounting flange plate 8. Springs, including the actuator springs 56 hold the rocker in a neutral position. In this neutral position neither of the push button switches 26 are actuated by the rocker since no significant force is applied through the actuator springs 56, which extend through holes 74 in the mounting plate. This neutral position is shown in FIGS. 3 and 4.

Figure 6:
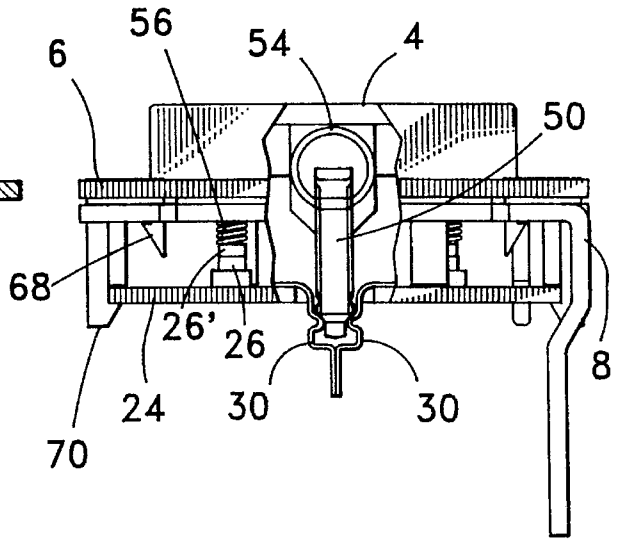
FIG. 6 is an end view, similar to FIG. 4, showing the rocker in the second or activated position shown in FIG. 5.
Figure 5:
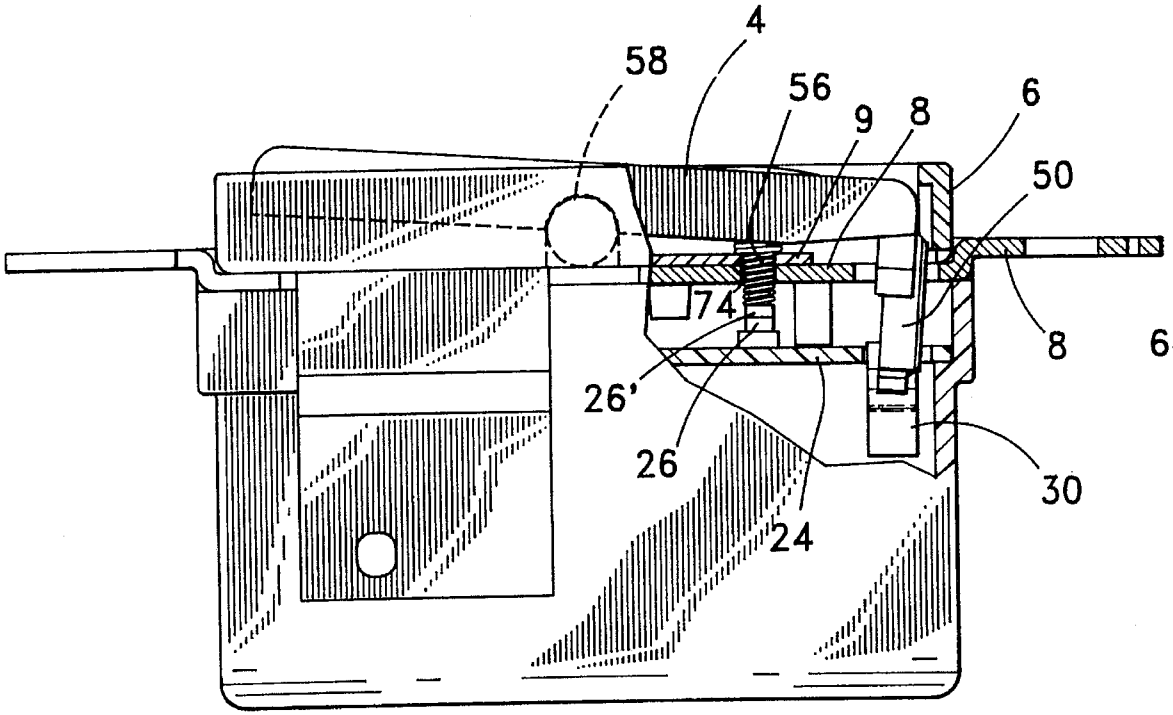
FIG. 5 is a side view, similar to FIG. 3, showing the rocker in a second or activated position in which a low voltage switch has been activated. Typically this is the position in which the power delivered to the load is reduced by dimming the load or by turning the load completely off.

When a force is applied to the bottom of the rocker (the end from which the air gap actuator post 50 extends), the rocker is rotated from the neutral position to the activated position shown in FIGS. 5 and 6. In this position sufficient force is applied to the lower rocker actuator spring 56 to close the corresponding push button switch 26, thus applying an input to the power control circuitry on the printed circuit board 24. Typically this switch actuation is interpreted by the power control circuitry as a DIM or OFF command. When the dimmer switch 2 is of the type described in U.S. patent application Ser. No. 08/303,967, now abandoned, filed Sep. 9, 1994 referred to previously, long, short and multiple pulses applied in this manner can have different preprogrammed consequences. In this second position, the air gap actuator post 50 does not engage either of the contact springs 30 and the air gap switch remains closed. The power control circuitry of the dimmer switch controls power to the load under normal circumstances and the air gap switch 20 is not opened to disconnect the load under normal circumstances. In the activated position of FIGS. 5 and 6, the power control circuitry will normally cause a change in the firing angle of the triac 22 on the printed circuit board 24. This triac 22 regulates power delivery to the load during normal operation.

FIGS. 7 and 8 show the rotation of the rocker 4 past the activated position of FIGS. 5 and 6 to its fully extended position. Note that a beveled surface on the lower end of the rocker has come into engagement with the top of the mounting flange plate 8 to prevent further rotation. In this position, the air gap actuator 50 has moved along the mating interface surface between contact springs 30 to separate the opposed contact tabs 32 and to open the air gap switch 20. The convex surfaces or ribs 38 have snapped into the inclined channels 52 to latch the rocker in place and to keep the air gap switch 20 in the open position. Since the rocker 4 is held in place by the bezel 6 and the bezel is attached to the flange plate 8 and the printed circuit board 24 respectively by latches 68 and 70, the rocker 4 cannot move from the position shown in FIGS. 7 and 8. Much greater force must be applied to the rocker 4 to move it from the second position to fully extended position and the lower end of the rocker 4 must be moved below the exterior surface of the bezel 6. This additional force and movement is necessary because this rocker position is needed only in certain exceptional conditions. For example, if there is a component malfunction that prevents the power control circuity from disconnecting the load or if the power control circuitry or power control components fail in the closed condition, opening the air gap switch is one way to disconnect the load. Also the load circuitry can be opened to allow maintenance on the load or to allow such simple tasks as changing a light bulb. The air gap switch can be closed by simply applying sufficient force to the opposite end of the rocker 4 to disengage the rocker actuator post 50 and the channels 52 from the convex latching ridges 38 holding the actuator in place.

Although the air gap switch and dimmer switch depicted herein comprise the preferred embodiment of this invention, they do not comprise the only embodiment of this invention that would be apparent to one of ordinary skill in the art. Numerous modifications could be made without departing from the invention as claimed herein. For example, the air gap switch actuator need not be limited to an integrally molded part of the dimmer rocker. A separate air gap actuator could be attached to the rocker during assembly of the dimmer switch. Furthermore the specific configuration of the air gap contact springs need not be that chosen as the preferred embodiment. For example other disengagable latching mechanisms could be employed. Instead of employing a stamped convex ridge in the intermediate section of the contact, a separate arm could be formed in a configuration to disenagably latch the air gap actuator when fully extended. The air gap switch could also be used with a dimmer switch that did not incorporate the remote control and preprogrammed control of the preferred embodiment. These and other modifications apparent tolone of ordinary skill in the art would not depart from the invention represented by the preferred embodiment.

We claim:

1. In an air gap switch in a dimmer switch to open a circuit between a source and a load controlled by the dimmer switch, the improvement comprising:

the air gap switch comprising opposed first and second contact springs, each contact spring including a contact tab located at a distal end and positioned to engage the contact tab of the opposed contact spring along a mating interface surface, the contact tabs being normally held in contact by opposed spring forces exerted by the first and second contact springs;

each contact spring comprising an intermediate contact section spaced from the mating interface surface, at least one of the contact springs including a convex surface facing toward, but spaced from the mating interface surface;

a mounting contact section on each contact spring for attaching the contact spring to a printed circuit board in said dimmer switch and to traces on the printed circuit board for ultimate connection to the source and load so that the air gap switch forms a part of the circuit between the source and the load; and an air gap switch actuator means mounted on said dimmer switch and being shiftable along the mating interface surface to a position separating the contact tabs on the first and second contact springs to open the circuit between the source and load, the convex surface engaging the air gap switch actuator means to disengagably latch the air gap switch actuator means in said position separating the contact tabs on the first and second contact springs.

2. The air gap switch in a dimmer switch of claim 1 wherein the air gap switch actuator means comprises a post having at least one channel engagable with a corresponding convex surface to disengagably latch the air gap switch actuator means between opposed contact tabs on the first and second contact springs.

3. The air gap switch in a dimmer switch of claim 2 wherein the air gap switch actuator means comprises rocker means, an extension located on one end of said rocker means pivoted about an axis spaced from the air gap switch actuator means.

4. The air gap switch in a dimmer switch of claim 3 wherein the rocker means is pivoted from a first position to each of a second position and a third position, sequentially, to actuate a push button switch while in each of the second position and the third position, the air gap switch actuator means being in a position separating the first and second spring contacts upon pivoting of the rocker means from the second position to the third position.

5. The air gap switch in a dimmer switch of claim 4 in which each channel is inclined relative to the centerline of the air gap switch actuator means so the corresponding convex surface on the corresponding contact spring is aligned with the channel as the air gap switch actuator means rotates relative to the contact springs as the rocker means pivots from the first position to each of the second position and the third position.

6. The air gap switch in a dimmer switch of claim 5 wherein the air gap switch actuator means is moved away from the contact springs by pivoting of the rocker means from the third position to the second position.

7. The air gap switch in a dimmer switch of claim 1 wherein the mounting contact section of each contact spring extends from the intermediate contact section transversely relative to the intermediate contact section and to the contact tab, the intermediate contact section and the contact tab forming parts of a cantilever beam extending from the mounting contact section.

8. The air gap switch in a dimmer switch of claim 1 wherein the printed circuit board to which the mounting contact sections are attached includes a notch between opposed contact springs to provide clearance for the air gap switch actuator means.

9. The air gap switch in a dimmer switch of claim 1 wherein each of the contact springs includes a convex surface on the intermediate contact section, and the air gap switch actuator means includes inclined channels on opposites faces thereof to engage the convex surfaces on the contact springs.

10. A switch for controlling the delivery of electrical power to a load, comprising a printed circuit board subassembly, an actuator subassembly and an air gap switch;

the printed circuit board subassembly including:

a printed circuit board;

a power control member on the printed circuit board for controlling power delivered to the load in response to a low voltage control signal;

an input termination for connection to a source of electrical power;

an output termination for connection to the load;

power control circuitry means on the printed circuit board for providing the low voltage control signal; and first and second switch means on the printed circuit board for switching on and off the low voltage control signal from the power control circuitry to the power control member;

the actuator subassembly comprising;

rocker means over the printed circuit board and including actuator means for actuating the first and second switch means upon pivoting the rocker means; and an air gap switch actuator means extending from one end of the rocker means;

the air gap switch being in a circuit between the input termination and the output termination and comprising;

first and second opposed contact springs extending downwardly from the printed circuit board subassembly and normally positioned in mutual contact along a mating interface to close the circuit between the input termination and the output termination, the air gap switch actuator means being normally positioned in alignment with and spaced from the mating interface of the first and second contact springs, the air gap switch actuator means being movable, upon pivoting of the rocker means, to a position between the air gap switch contact springs to open the circuit between the input termination and the output termination.

11. The switch of claim 10 wherein at least one of the contact springs includes a disengagable latching surface for disengageably engaging the air gap switch actuator means to retain the air gap switch actuator means in said position between the first and second contact springs.

12. The switch of claim 11 wherein the air gap switch actuator means includes a channel for engaging the disengagable latching surface.

13. The switch of claim 10 wherein the first and second contact springs project through a notch in one end of the printed circuit board.

14. The switch of claim 13 wherein the first and second contact springs comprise stamped and formed members, mounting sections attached to traces on the printed circuit board, contact sections located at distal ends thereof, the contact sections being in mutual contact along the meeting interface, and a disengagable latching section on each contact spring between the contact section and the mounting section.

15. The switch of claim 13 wherein each disengagable latching section includes a convex surface formed inwardly and located above and spaced outwardly from the corresponding contact section which extends axially downwardly beyond the disengagable convex surface.

* * * * *